US008544172B2

(12) United States Patent
Kamber

(10) Patent No.: US 8,544,172 B2
(45) Date of Patent: Oct. 1, 2013

(54) CLAMPING APPARATUS FOR A CRIMPING MACHINE AND METHOD FOR PRODUCING A CRIMPED CONNECTION WITH A CRIMPING MACHINE AND THE CLAMPING APPARATUS ACCORDING TO THE INVENTION

(75) Inventor: Patrik Kamber, Matzendorf (CH)

(73) Assignee: Schleuniger Holding AG, Thun (CH)

( * ) Notice: Subject to any disclaimer, the term of this patent is extended or adjusted under 35 U.S.C. 154(b) by 1323 days.

(21) Appl. No.: 12/305,083

(22) PCT Filed: Jun. 14, 2007

(86) PCT No.: PCT/IB2007/001590

§ 371 (c)(1),
(2), (4) Date: Dec. 16, 2008

(87) PCT Pub. No.: WO2007/144752

PCT Pub. Date: Dec. 21, 2007

(65) Prior Publication Data

US 2009/0205205 A1 Aug. 20, 2009

(30) Foreign Application Priority Data

Jun. 16, 2006 (CH) ..... 995/06

(51) Int. Cl.
*H01R 43/04* (2006.01)
*H01R 43/042* (2006.01)

(52) U.S. Cl.
USPC ..... 29/863; 29/751; 29/753

(58) Field of Classification Search
USPC ..... 29/863, 751, 753, 882; 7/107
See application file for complete search history.

(56) References Cited

U.S. PATENT DOCUMENTS

| | | | | | |
|---|---|---|---|---|---|
| 2,765,468 | A | * | 10/1956 | Cootes et al. | 29/566.2 |
| 3,263,316 | A | * | 8/1966 | Schrader | 29/714 |
| 3,386,153 | A | * | 6/1968 | Lau et al. | 29/565 |
| 3,416,213 | A | * | 12/1968 | Cootes | 29/753 |
| 3,481,018 | A | * | 12/1969 | Lodevicus | 29/566.2 |
| 3,541,654 | A | * | 11/1970 | Hills | 29/33.5 |
| 3,745,807 | A | * | 7/1973 | Vogel et al. | 72/421 |
| 3,839,776 | A | * | 10/1974 | Anderson et al. | 29/862 |

(Continued)

FOREIGN PATENT DOCUMENTS

| | | | |
|---|---|---|---|
| DE | 9102633 | U1 | 8/1992 |
| DE | 19511372 | A1 | 10/1996 |

(Continued)

*Primary Examiner* — David Angwin
(74) *Attorney, Agent, or Firm* — Davis & Bujold, PLLC; Michael J. Bujold

(57) ABSTRACT

A clamping apparatus, for a crimping machine (1), which comprises a crimping tool head (2) with an end wall (9), in a cable feed direction, a crimping tool base body (3) with an anvil (4) and a front knife (21), an insulation stripping apparatus (5); a contact element feed apparatus (6); and a coupling part (7) for coupling the crimping machine (1) to the crimping tool head (2). The clamping apparatus (10) clamping the electric cable (8) to be processed both during the insulation stripping and crimping processes. The clamping apparatus (10) is connected to the crimping tool head (2) via its end wall (9) and is movable vertically with the crimping tool head (2). At least one of the clamping apparatus (10) and the crimping tool head (2) is arranged centrally in a longitudinal direction of the cable path (8') above the anvil (4) and the front knife (21).

8 Claims, 6 Drawing Sheets

(56) References Cited

U.S. PATENT DOCUMENTS

Figure 1:
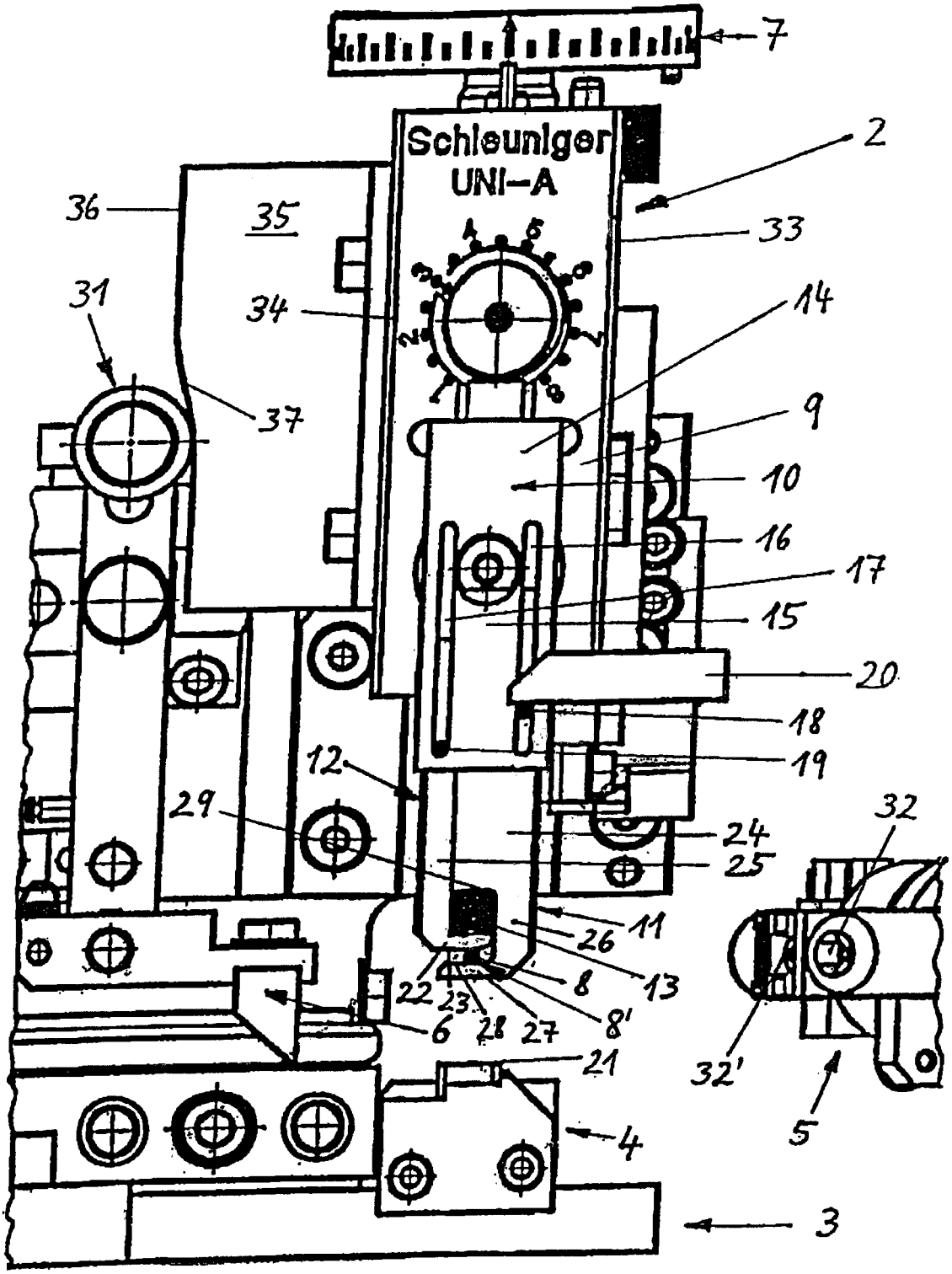

| | | | | | |
|---|---|---|---|---|---|
| 4,025,999 | A | * | 5/1977 | Wolyn et al. | 29/753 |
| 4,031,613 | A | * | 6/1977 | Brown et al. | 29/863 |
| 4,040,180 | A | * | 8/1977 | Brown | 29/753 |
| 4,114,253 | A | * | 9/1978 | Loomis et al. | 29/566.2 |
| 4,177,549 | A | * | 12/1979 | Mori et al. | 29/564.2 |
| 4,178,675 | A | * | 12/1979 | Phillips | 29/566.1 |
| 4,283,846 | A | * | 8/1981 | Collier | 29/753 |
| 4,365,400 | A | * | 12/1982 | Carlomagno | 29/235 |
| 4,451,965 | A | * | 6/1984 | Carlomagno | 29/450 |
| 4,489,589 | A | * | 12/1984 | Kirsinas et al. | 72/424 |
| 4,707,913 | A | * | 11/1987 | Moline | 29/753 |
| 4,718,160 | A | * | 1/1988 | Bulanda et al. | 29/566.2 |
| 4,821,383 | A | * | 4/1989 | Grosklos et al. | 29/33 M |
| 4,845,833 | A | * | 7/1989 | Weresch | 29/566.3 |
| 4,896,419 | A | * | 1/1990 | Jurgenhake et al. | 29/861 |
| 4,918,804 | A | * | 4/1990 | Bleuel et al. | 29/33 M |
| 4,979,291 | A | * | 12/1990 | Phillips et al. | 29/863 |
| 5,074,033 | A | * | 12/1991 | Dassance et al. | 29/753 |
| 5,095,609 | A | * | 3/1992 | Correll et al. | 29/564.2 |
| 5,127,255 | A | * | 7/1992 | Skotek | 72/421 |
| 5,131,124 | A | * | 7/1992 | Skotek | 29/33 M |
| 5,333,482 | A | * | 8/1994 | Dunlap et al. | 72/307 |
| 5,440,799 | A | * | 8/1995 | Marshall et al. | 29/566.2 |
| 5,481,796 | A | * | 1/1996 | Quinn | 29/753 |
| 5,491,887 | A | * | 2/1996 | Quinn | 29/753 |
| 5,564,613 | A | * | 10/1996 | Baldyga | 242/615.3 |
| 5,666,719 | A | * | 9/1997 | Bair | 29/753 |
| 5,687,613 | A | * | 11/1997 | Swedberg | 72/424 |
| 5,774,977 | A | * | 7/1998 | Folk et al. | 29/753 |
| 5,799,391 | A | * | 9/1998 | Tillotson | 29/753 |
| 5,884,394 | A | * | 3/1999 | Ichikawa | 29/760 |
| 6,026,562 | A | * | 2/2000 | McMillin et al. | 29/748 |
| 6,367,148 | B1 | * | 4/2002 | Caveney et al. | 29/753 |
| 6,601,290 | B2 | * | 8/2003 | Stakem | 29/742 |
| 6,655,013 | B2 | * | 12/2003 | Wilson et al. | 29/751 |
| 7,117,713 | B2 | * | 10/2006 | Lu | 72/409.14 |
| 7,353,677 | B2 | * | 4/2008 | Zusi | 72/15.1 |
| 7,490,498 | B2 | * | 2/2009 | Zusi | 72/15.1 |
| 7,870,667 | B2 | * | 1/2011 | Takada | 29/861 |
| 8,061,027 | B2 | * | 11/2011 | Garner, Jr. | 29/861 |
| 8,113,402 | B2 | * | 2/2012 | Stakem | 226/68 |

FOREIGN PATENT DOCUMENTS

| | | | |
|---|---|---|---|
| DE | 19615564 | C1 | 7/1997 |
| EP | 0303724 | A1 | 2/1989 |
| EP | 0887897 | A2 | 12/1998 |

* cited by examiner

CLAMPING APPARATUS FOR A CRIMPING MACHINE AND METHOD FOR PRODUCING A CRIMPED CONNECTION WITH A CRIMPING MACHINE AND THE CLAMPING APPARATUS ACCORDING TO THE INVENTION

The invention relates to a clamping apparatus for a crimping machine, for clamping an electric cable, and a method for producing a crimped connection with a clamping apparatus according to the invention.

Today, in addition to being equipped with the actual crimping tool, crimping machines are often equipped today, inter alia, with an insulation stripping apparatus and have a clamping apparatus for clamping the electric cable to be crimped onto a contact element, the clamping apparatus clamping the cable both during the insulation stripping process and during the crimping process.

A clamping apparatus of a combined insulation stripping/crimping apparatus is disclosed, for example, in DE-C2 195 11 372. The clamping apparatus is arranged perpendicularly to the baseplate of the base frame and connected in a stationary manner therewith. The clamping apparatus has a support element mounted on the front wall and having a passage for that end of the electric cable which is to be produced. One adjusting arm each is pivotably hinged to both ends of a T-shaped member having a horizontal transverse beam, each adjusting arm carrying a clamping jaw. The clamping jaws are arranged so that they are symmetrical to the passage at the top and bottom. The adjusting arms are displaceable in the vertical direction by virtue of the fact that an adjusting lever is hinged to the free end of the T-shaped member and is joined in an articulated manner to the drive with an angle lever via a roller/cam mechanism. The free end of the adjusting lever is drawn away from the support element by means of a tension spring, the tension spring attempting to close the clamping jaws. The pivoting of the T-shaped member via a highly complicated mechanism finally leads to the raising or to the lowering of the adjusting arms. The clamping jaws connected to the adjusting arms are moved toward one another in order to clamp the conductor or are moved back to the zero position if the processed conductor is to be removed and a new conductor is to be inserted. In order to start the insulation stripping process, an electric cable is moved into the passage. During this process, it makes contact with the switching plate of a micro switch on the knife head of the insulation stripping unit. As a result of the contact, the motor is switched on by means of the micro switch so that the conductor end is clamped by means of the clamping jaws. The cutting knives now move toward one another and cut through the conductor insulation. The cutting knives are then moved by the carriage in the direction of the rear wall so that the cut-through conductor insulation is stripped off while the conductor is still clamped. In the meantime, the two pivot arms of the insulation stripping unit move far apart, the wire end sleeve to be processed is separated from the wire end sleeve belt and fed to the cavity in the crimping drum, and the cavity is moved to the crimping position. The stripped conductor end is introduced via an inlet funnel into the wire end sleeve to be processed, after which a crimping process takes place. Thereafter, the inlet funnel is released again via a spindle, and the clamping jaws of the clamping apparatus are removed from one another. The crimped conductor end can now be removed from the apparatus. The carriage returns to its starting position until a new working cycle is started via the switching plate.

This combined insulation stripping/crimping apparatus was further developed by DE-C1196 15 564 so that reliable crimping and hence better crimping results could be achieved. This insulation stripping/crimping apparatus, too, contains a stationary clamping device for clamping a wire from which insulation is to be stripped, an insulation stripping device which is moveable in the longitudinal direction of the conductor end and a crimping device which is likewise moveable in the longitudinal direction of the conductor end in order to push a contact element onto the stripped part of the conductor end and to crimp it therewith. What is novel compared with DE-C2 195 11 372 is that a centering device for the conductor end is arranged on that side of the clamping device which faces the crimping device, it also being possible for the centering device to be moveable in the longitudinal direction of the conductor end. Such a centering device ensures that the clamped conductor end is better retained in its required position, which becomes more and more difficult particularly in the case of conductors having increasingly small cross-sections.

Such apparatuses are complicated and are composed of many parts. The large number of cams and joints requires a high level of maintenance.

German Utility Model DE-U191 02 633.4 discloses a cable crimping apparatus comprising an insulation stripping device, in which the clamping apparatus for the cable to be processed is a part of the insulation stripping device. On insertion of the front region of a cable into the opening of a slot of a fixed clamping jaw, which slot is open at the bottom, the insulation stripping device is started via a starting apparatus. The fixed clamping jaw cooperates with an advanceable clamping jaw. The inserted cable rests with the underside of its rear region on a support which simultaneously forms a part of a holder for a fixed insulation stripping knife. The fixed insulation stripping knife cooperates with an advanceable insulation stripping knife, likewise in the horizontal direction. The starting apparatus triggers a downward stroke of the plunger-like apparatus part of the insulation stripping apparatus. The vertical movement is converted via the wedge surfaces of the apparatus part and the one double-arm drive lever via its axis into a spring-loaded horizontal movement of a slide which forms and carries the clamping jaw at its front end. In the case of a perpendicular downward movement of the insulation stripping apparatus, the cable clamping apparatus is closed thereby and holds the cable firmly. The cable is now freed from its insulation at its front end by the insulation stripping knives, and the section separated off is pulled off the wire end by the insulation stripping apparatus. Thereafter, the clamping apparatus and with it the stripped cable are lowered via the plunger onto the die and the stripped end of the cable is crimped with the contact element by the crimping apparatus. The clamping apparatus is still closed. At its lower end, the drive lever of the insulation stripping apparatus carries a control pin which cooperates with a motion linked to the apparatus. Once the control pin has reached the lower end of the wedge surface during the downward movement, a blocking member is pushed upward against the resistance of a restoring spring. During the subsequent upward stroke, the control pin slides along the blocking member and opens the cable clamping apparatus. Such a clamping apparatus, too, is controlled via a highly complicated mechanism requiring intensive maintenance. It must also be moveable itself since insulation stripping process and crimping process are not carried out at the same location.

It is an object of the invention to provide a clamping apparatus for an electric cable to be crimped, which clamping apparatus applies sufficient force with little mechanical effort to hold the cable and ensures positionally accurate clamping during the entire insulation stripping and crimping process. The clamping apparatus is to be designed to be simple, low-maintenance and hard-wearing and is to permit short stripping of the sheath of the cable to be crimped. It is also an object of the invention to carry out in an economical manner the method for the production of a crimped connection by using the clamping apparatus according to the invention.

This object is achieved by a clamping apparatus having the features of claim 1 and a method for the production of a crimped connection with a crimping machine and the clamping apparatus according to the invention according to claim 10. Advantageous embodiments are stated in the sub claims.

According to the invention, the clamping apparatus for a crimping machine is connected to the crimping tool head via its end wall and is moveable vertically with the crimping tool head. Both clamping apparatus and crimping tool head are arranged centrally in the longitudinal direction of the electric cable to be clamped, above the anvil and the front knife. Only the vertical movement of the crimping tool head is used for driving the clamping movement of the clamping apparatus. The crimping tool head and, with it, the clamping apparatus move over an eccentric cam which is arranged in the crimping machine and determines the stroke of the crimping tool.

The clamping apparatus consists of at least two clamping jaws, an upper and a lower clamping jaw. The clamping jaws are pressure spring-loaded in the vertical direction via one or more spring elements, for example pressure springs, and are therefore moveable in opposite directions to one another. In the case of a defined partial rotational movement of the eccentric cam, the maximum pressure of the pressure springs is reached and the cable is clamped between the clamping jaws. A limiting arm mounted on the crimping tool base body and against which a clamping jaw provided with a pin is supported during the upward stroke opens the clamping apparatus again during the upward stroke.

The method according to the invention for producing a crimped connection with a crimping machine and with the clamping apparatus according to the invention is effected in five operations:

in a first operation in which the crimping machine is in the starting position, a cable to be processed is fed through the opened clamping jaws of the clamping apparatus and through the cable passages of the insulation stripping apparatus, which is present directly behind, onto the triggering sensor of the insulation stripping apparatus.

in a second operation, triggered by the triggering sensor, the crimping tool head is displaced in a vertical downward movement approximately by the height of the clamping jaw opening minus the cable thickness downward until the cable is clamped in a non-slip manner between the top of the lower clamping jaw finger and the bottom of the upper clamping jaw finger with a press fit. By a partial downward movement of the crimping tool head, which remains stationary in this position, the pressure spring-loaded clamping jaw finger of the upper clamping jaw is pressed against the cable to be processed in the direction of the lower clamping jaw finger and the cable is clamped.

in a third operation, the insulation stripping process is effected by the insulation stripping apparatus in a known manner, after which the insulation stripping apparatus is moved out of the processing region.

in a fourth operation, the actual crimping process is effected without the stripped cable having to be moved on horizontally. The clamping jaws which clamp the cable in a non-slip manner without change in a press fit are moved together with the crimping tool head, likewise remaining in its horizontal starting position, in a rapid stroke vertically in the direction of the anvil, and the cable end is crimped in a known manner by at least one crimp die with the contact element present there. The contact to be crimped is separated from the belt by the front knife, by the clamping apparatus which also functions as a front knife pusher.

in a fifth operation, crimping tool head and clamping apparatus are moved back vertically to their starting position. As soon as the pin of the lower clamping jaw is gripped again by the limiting arm, the clamping jaws begin to open and the finished cable with the crimped-on contact element can be removed after reaching the starting position. The insulation stripping apparatus likewise travels to its starting position, and the crimping machine is ready again for carrying out the first operation (a).

Since the insulation stripping apparatus can be moved directly onto those side walls of the clamping jaws which point in the direction of the crimping tool head, the stripping of the cable insulation material is effected directly adjacent to the clamping jaw fingers. The mounting of the clamping apparatus according to the invention directly on the end wall of the crimping tool head, behind which the crimp dies are present, also ensures a minimum distance between clamping jaw fingers and crimp dies. Even thin cables can be introduced in this way into the crimping claw region of a contact element without problems and can be crimped there without the stripped end of the cable being able to bend or spread in an undesired manner, which might lead to irritation during the crimping process. Moreover, owing to the short distance between the cable clamping and the cable end, no separate centering device for stability and orientation of the cable during the entire processing is required. While the sheath-stripping length is about 23 mm in the case of a contact element having a crimp zone length of 6 mm in the known crimping machines, a crimp zone length of about 13 mm is achieved with the use of the clamping apparatus according to the invention, which means a substantial improvement compared with the conventional clamping apparatuses.

A further advantage is that the clamping apparatus according to the invention can be mounted on any other crimping tool of similar design without major assembly effort and can therefore serve as a separate commercial part for retrofitting of older models.

The invention is explained in more detail below with reference to the working example shown in the drawings.

Figure 2:
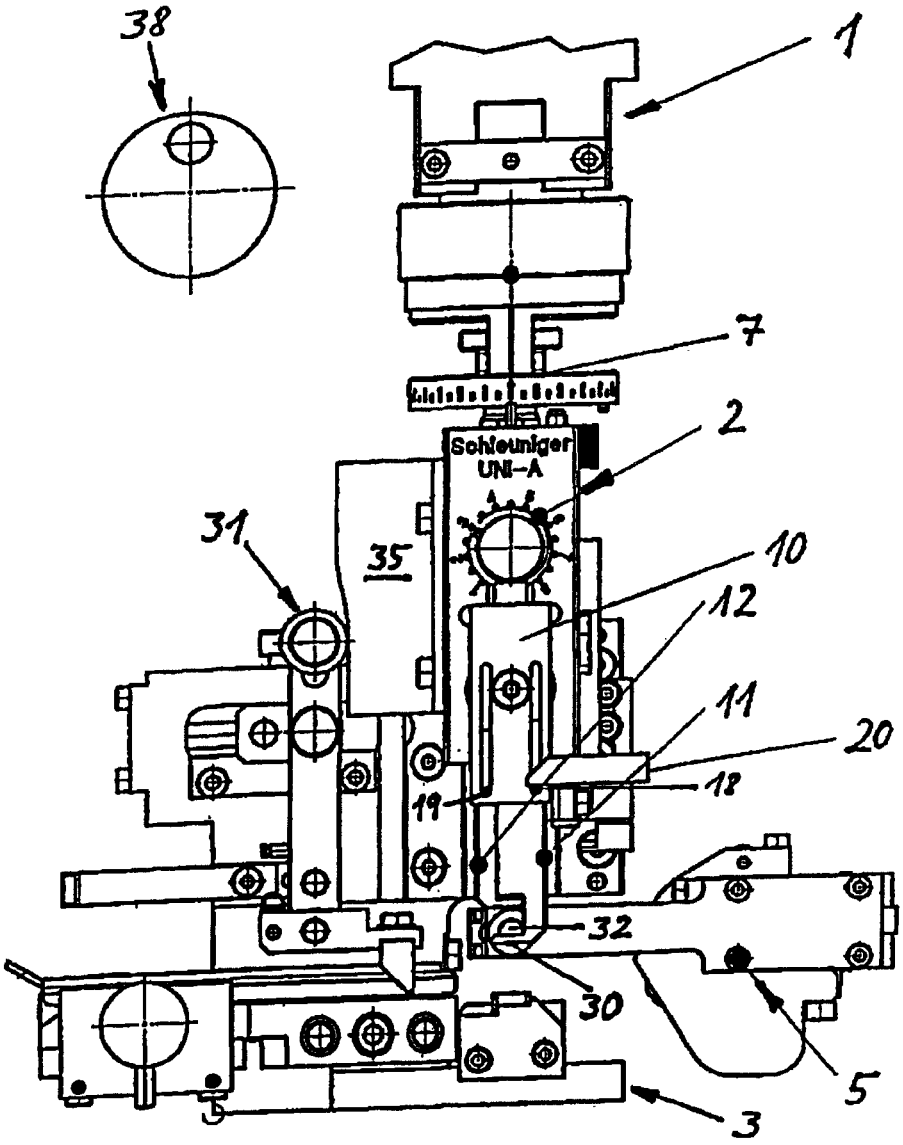
Figure 3:
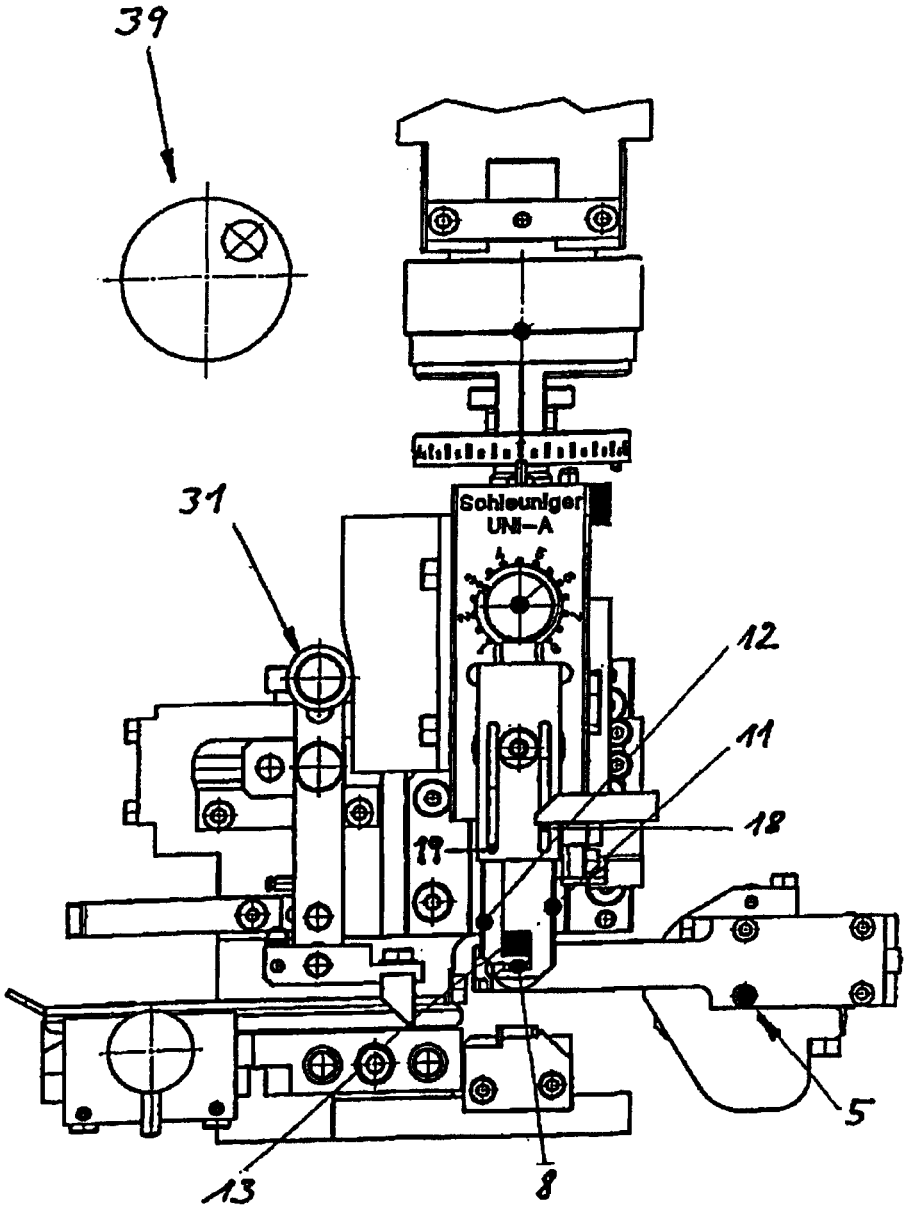
Figure 4:
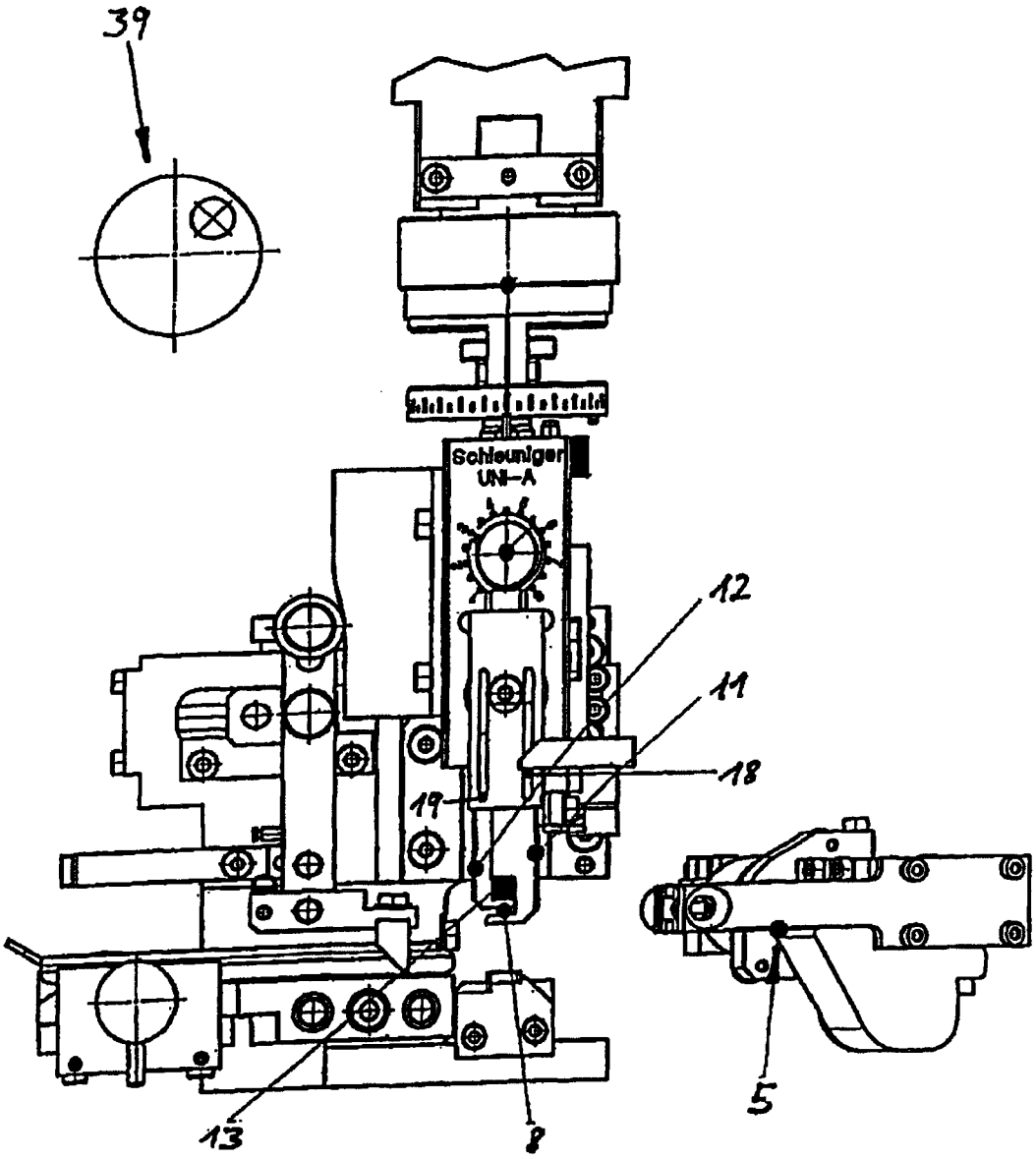
Figure 5:
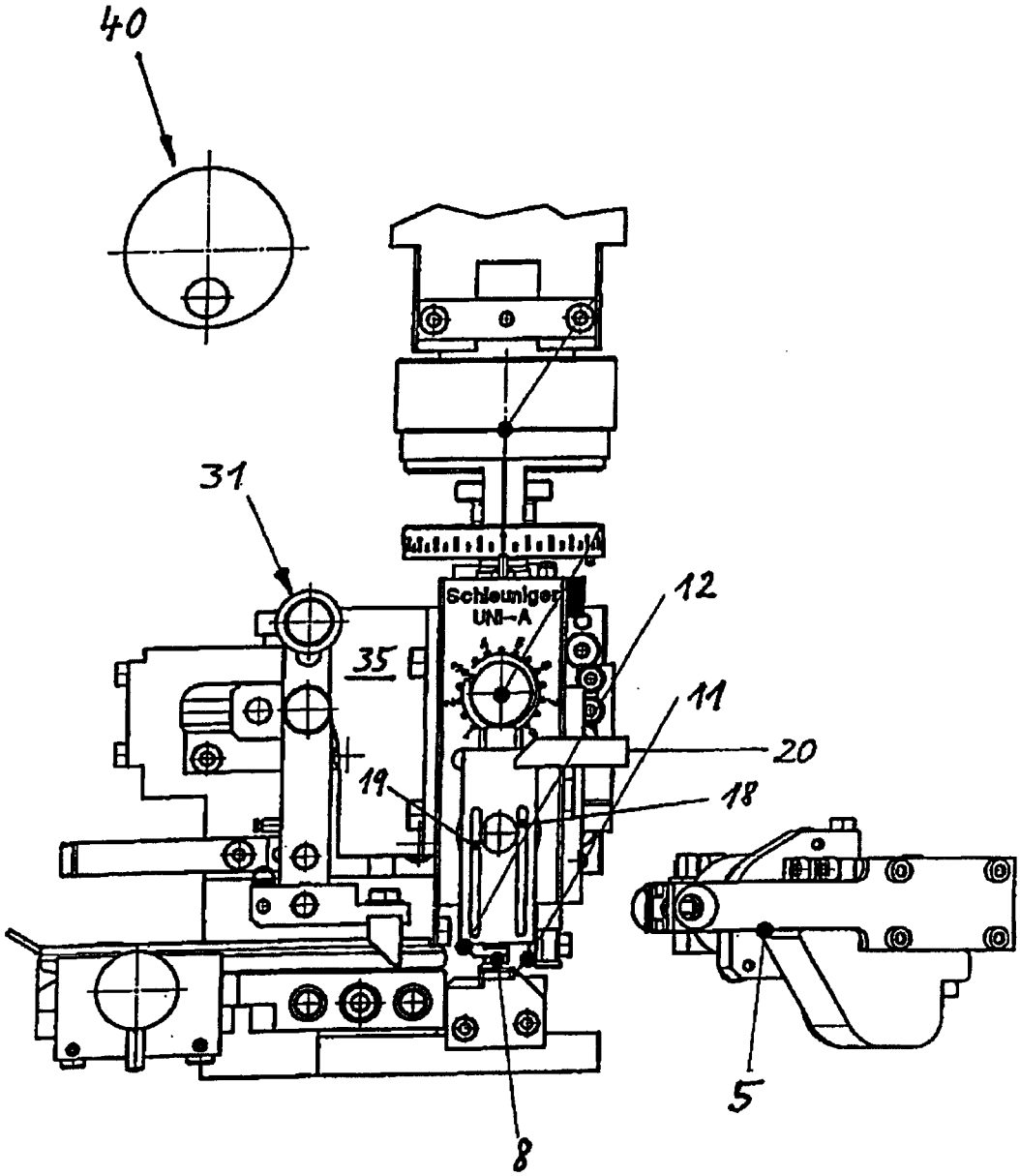
Figure 6:
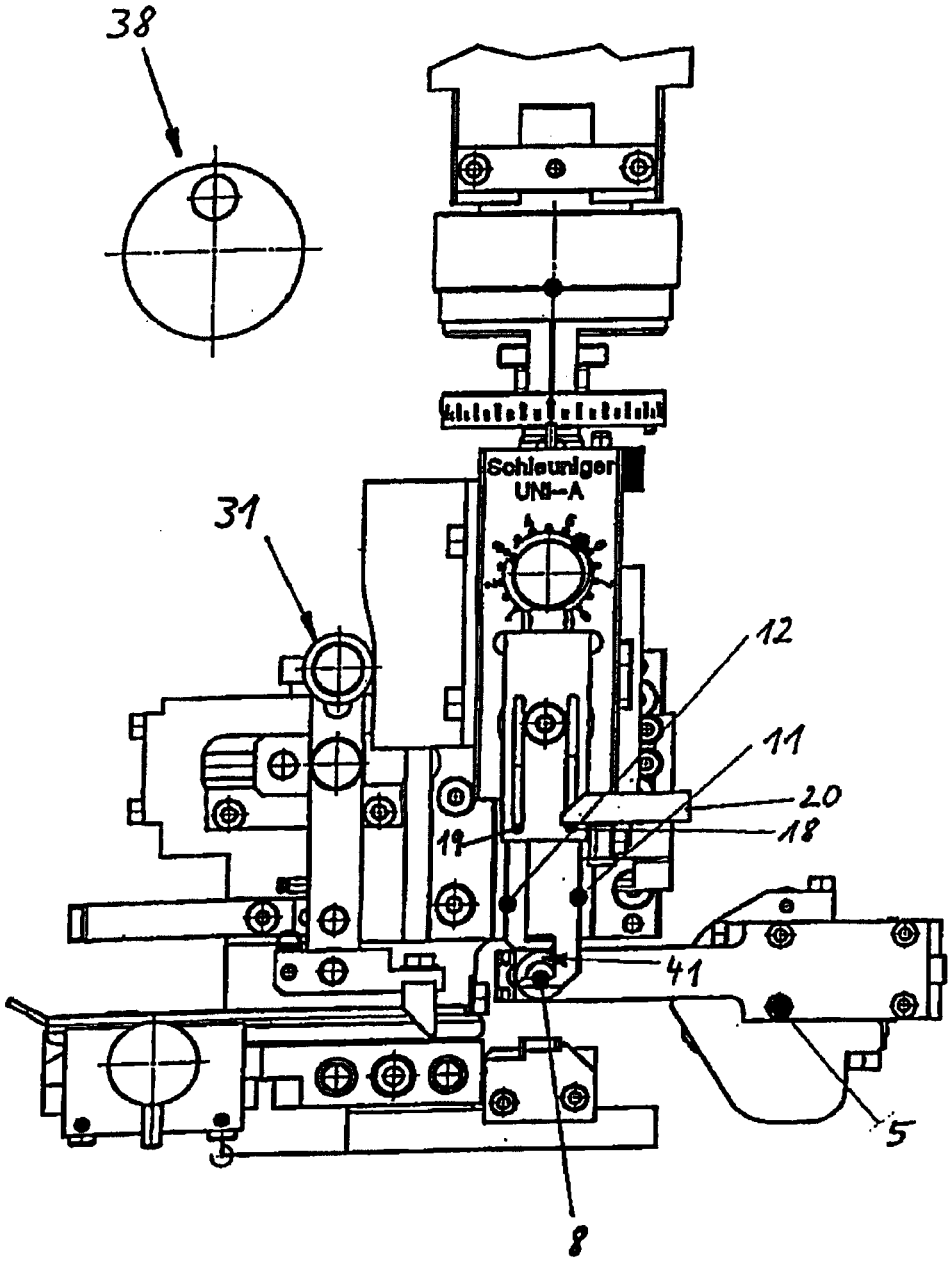

FIG. 1 shows a partial magnified view of the clamping apparatus according to the invention with all essential functional elements of the crimping machine according to the invention in a front view with clamped cable, FIG. 2 shows the front view of the crimping machine according to the invention during the first operation, FIG. 3 shows the front view of the crimping machine according to the invention during the second operation, FIG. 4 shows the front view of the crimping machine according to the invention during the third operation, FIG. 5 shows the front view of the crimping machine according to the invention during the fourth operation, FIG. 6 shows the front view of the crimping machine according to the invention during the fifth operation.

The clamping apparatus 10 shown in FIG. 1 is intended for a crimping machine 1 having a crimping tool head 2, a crimping tool base body 3 with an anvil 4 and a front knife 21 mounted upstream of the anvil 4, further having an insulation stripping apparatus 5, a contact element feed apparatus 6 and a coupling part 7 for coupling the crimping machine 1 to the crimping tool head 2, which is moveable vertically for executing a crimping stroke. The crimping tool head 2 has an end wall 9, in the direction of which a cable 8 to be crimped can be fed along a cable path 8'. The clamping apparatus 10 clamps the electric cable to be processed in the operating state both during the insulation stripping process and during the crimping process. According to the invention, the clamping apparatus 10 is connected to the crimping tool head 2 via its end wall 9 and can be moved vertically together with the crimping tool head 2. The clamping apparatus 10 and/or the crimping tool head 2 are preferably arranged centrally in the longitudinal direction of the cable path 8' above the anvil 4 and the front knife 21. To ensure a rigid fit of the clamping apparatus 10 on the crimping tool head 2, detent recesses or bores can be prefabricated in the end wall 9 of the crimping tool head 2, which detent recesses or bores permit a rapid screw, plug and/or clamping connection to the crimping tool head 2 or its end wall 9. However, these are not absolutely essential.

The clamping apparatus 10 has at least two clamping jaws, an upper clamping jaw 12 and a lower clamping jaw 11, which are moveable in opposite directions to one another in the vertical direction via one or more spring elements, for example pressure springs 13. The clamping jaws 11, 12 are arranged so as to be moveable in a cuboid housing 14 open at least at the bottom. The housing 14 is provided on its top 15 with two slots 16, 17 arranged parallel to one another and perpendicularly to the longitudinal direction of the cable 8, as described in detail further below. The upper clamping jaw 12 comprises a clamping jaw arm 25 and a clamping jaw finger 22 bent at right angles in the direction of the lower clamping jaw 11, the bottom 23 of the finger clamping the cable 8 during the entire processing. The lower clamping jaw 11 has a substantially cuboid clamping jaw arm 24 with a lower edge 29, an arm extension 26, which is approximately half as wide as the clamping jaw arm 24 and which corresponds approximately to the width of the clamping jaw arm 25, and a clamping jaw finger 27 bent from the arm extension 26 at right angles in the direction of the upper clamping jaw 12. The pressure springs 13 are fixed in a cavity of the clamping jaw arm 24 above the lower edge 29. At least one pin 18, 19 each having different lengths is attached to each clamping jaw 11, 12 in the region of the clamping jaw arms 24, 25, the longer pin 18 of the lower clamping jaw 11 passing through the first slot 16 in the top 15 of the housing 14 and the shorter pin 19 of the upper clamping jaw 12 passing through the second slot 17, the slots 16, 17 together serving for guiding the clamping jaws 11, 12 during the execution of the vertical movement of the crimping tool head 2 and of the clamping apparatus 10. The pins 18, 19 form the end stops for the open position of the clamping jaws 11, 12.

In this working example, an L-shaped limiting arm 20 is arranged horizontally relative to the longitudinal direction of the cable 8 on the base body 3 at approximately half height, which limiting arm extends in its longitudinal dimension beyond the side wall 33 of the crimping tool head 2 and the clamping apparatus 10 and is bent at right angles in the direction of the top 15 of the clamping apparatus 10 approximately from the second third of its length, said limiting arm extending beyond the top 15 at most by a half with play, and said limiting arm, in its end region, being in direct contact with the longer pin 18 above said longer pin. During the upward stroke, the lower clamping jaw arm 24 is supported on the limiting arm 20 via the longer pin 18 formed on the lower clamping jaw 11 and in this way opens the clamping jaw fingers 22, 27 again during the upward stroke.

FIGS. 2 to 6 show the method for producing a crimped connection with a crimping machine 1 and with the clamping apparatus 10 according to the invention in five operations which take place in succession as follows:

In a first operation according to FIG. 2, in which the crimping machine 1 is in the starting position, a cable 8 to be processed is fed along the cable path 8' through the clamping jaw opening 41 of the opened clamping jaws 11, 12 of the clamping apparatus 10 and through the cable passages 32, 32' of the insulation stripping apparatus 5 which are directly behind, up to the triggering sensor 30 of the insulation stripping apparatus, the clamping jaw opening in this working example being about 5 mm. During the first operation, the limiting arm 20 makes contact with the pin 18 of the lower clamping jaw arm 24 at the lowermost end of the first slot 16 and thereby holds the lower clamping jaw finger 27 in the starting position. The upper clamping jaw arm 25, too, is present in the starting position, its pin 19 being positioned at the lower end of the second slot 17.

In a second operation (FIG. 3), the crimping tool head 2 is displaced in a vertical downward movement, which corresponds approximately to the height of the clamping jaw opening 41 on introduction of the cable 8, downward until the cable 8 is clamped in a non-slip manner between the top 28 of the lower clamping jaw finger 27 and the bottom 23 of the upper clamping jaw finger 22 with a press fit. The crimping tool head 2 remains stationary in this position. In the present working example, the downward stroke is <5 mm. The pin 18 on the lower clamping jaw arm 24 thereby executes a relative upward movement of <5 mm in the first slot 16 of the clamping jaw housing 14. Thus, the lower clamping jaw arm 24 remains in the position of the first operation because of the limiting arm 20 fixed in a stationary position. The clamping of the cable 8 is effected by the spring-supported clamping mechanism, in particular by the pressure springs 13. The insulation stripping process is now effected by the insulation stripping apparatus 5 in a known manner.

In a third operation, the insulation stripping apparatus 5 is moved out of the processing region (FIG. 4).

In a fourth operation (FIG. 5), a contact element (not shown) is fed by the contact element feed apparatus 6 onto the anvil 4 and the actual crimping process takes place immediately afterward. The clamping jaws 11, 12, which clamp the cable 8 in a non-slip manner without changes with a press fit, are moved together with the crimping tool head 2 in a fast stroke vertically in the direction of the anvil 4, and the cable end is crimped by at least one crimp die (not shown) to a contact element (not shown) on the anvil 4 in a known manner. At the same time, the electric contact element (not shown) to be crimped is separated from the belt by the front knife 21, by the clamping apparatus which also functions as a front knife pusher. As a result of the constant pressure of the pressure springs 13, the clamping jaw fingers 22, 27 remain the same distance apart so that loosening of the clamped cable 8 during the crimping process cannot take place.

In a fifth operation (FIG. 6), the crimping tool head 2 is displaced in a stroke vertically upward to the zero position or to the upper dead point, and pin 18 makes contact with the limiting arm 20 and moves to the lowermost stop point in the first slot 16, the upper clamping jaw arm 25 beginning to open as soon as pin 18 has exceeded the pin position of the second or third operation. The crimping machine 1 is thus once again in its starting position, the finished cable 8 with the crimped-on contact element can be removed and the crimping machine is ready again for carrying out the first operation according to FIG. 2.

The vertical movement of the clamping apparatus 10 takes place via three cam positions 38, 39, 40 of an eccentric cam (not shown) which is arranged in the crimping machine and determines the stroke of the crimping tool. In a first cam position 38 according to FIG. 2, crimping tool head 2 and clamping apparatus 10 are in the starting position. The clamping jaws 11 and 12 are open. In a second cam position 39, a partial movement of the eccentric cam has already taken place. In this region, clamping of the cable 8 takes place. In the working example according to FIG. 4, the eccentric cam has rotated through about 45°. The angle of rotation can, however, be from 10 to 120°, depending on cable thickness and desired pressure. In a third cam position 40, the eccentric cam has covered the maximum path of 180° according to FIG. 5, the contact element (not shown) is crimped to the cable 8, the eccentric cam moves back to its starting position 38 (FIG. 6) and the clamping jaws 11, 12 are open again.

The feed of the contact element feed apparatus 6 is controlled via a plate 35 fixed to the sidewall 34 opposite the sidewall 33, so that the plate 35 has a sinuous gradation 37 in the lateral edge 36 and engages a roller cam follower 31.

It is within the scope of protection of the invention to fix the pressure springs 13 not in the upper clamping jaw arm but on that side of the upper clamping jaw finger 22 which faces the lower edge 29 of the lower clamping jaw arm 24.

It is also within the scope of protection of the invention to introduce into the top 28 of the lower clamping jaw finger 27 at least one bore into which a pin is inserted for positioning, and the pin points in the direction of the bottom 23 of the finger of the upper clamping jaw arm. The pin forms the lateral limit, opposite the arm extension 26 of the lower clamping jaw arm 24, for the clamping jaw opening 41. Depending on the thickness of the cable to be processed, said pin serves as a positioning aid for the cable 8 and secures it to prevent lateral slipping out of the clamping jaw opening 41.

It is furthermore within the scope of protection of the invention that the triggering sensor is an inductive proximity sensor and that the cable 8 to be processed, after introduction into the cable passages 32, 32' of the insulation stripping apparatus 5, presses on a first sensor, the latter moving backward and thereby activating the triggering sensor, which is preferably arranged at right angles to the first sensor. Via this indirect activation of the triggering sensor, the depth of insertion of the cable 8 to be stripped of insulation can be controlled more precisely.

LIST OF REFERENCE NUMERALS

1. Crimping machine
2. Crimping tool head
3. Crimping tool base body
4. Anvil
5. Insulation stripping apparatus
6. Contact element feed apparatus
7. Coupling part
8. Cable
8'. Cable path
9. End wall
10. Clamping apparatus
11. Lower clamping jaw
12. Upper clamping jaw
13. Pressure springs
14. Housing
15. Top
16. First slot (for pin 18)
17. Second slot (for pin 19)
18. Pin (long)
19. Pin (short)
20. Limiting arm
21. Front knife
22. Upper clamping jaw finger
23. Finger bottom (of the upper clamping jaw arm 25)
24. Lower clamping jaw arm
25. Upper clamping jaw arm
26. Arm extension (of the lower clamping jaw arm)
27. Lower clamping jaw finger
28. Top (of the lower clamping jaw finger 27)
29. Lower edge (of the lower clamping jaw arm 24)
30. Triggering sensor
31. Roller cam follower
32. 32'. Cable passages
33. Side wall of the crimping tool head (right)
34. Side wall of the crimping tool head (left)
35. Plate
36. Lateral edge (of the plate 35)
37. Gradation
38. Cam position (first)
39. Cam position (second)
40. Cam position (third)
41. Clamping jaw opening

The invention claimed is:

1. A crimping machine, comprising:
a crimping tool head having an end face arranged transverse to a cable path, along which a cable to be crimped is fed in operation of the crimping machine;
a crimping tool base body having an anvil and a front knife,
an insulation stripping apparatus;
a contact element feed apparatus; and
a coupling part for coupling the crimping machine to the crimping tool head;
a clamping apparatus being connected to the crimping tool head via said end face wherein said clamping apparatus can be moved vertically with the crimping tool head, and wherein at least one of the clamping apparatus and the crimping tool head is arranged centrally in a longitudinal direction of the cable path above the anvil and the front knife wherein the clamping apparatus is designed to clamp the electric cable to be processed, both during an insulation stripping process performed by the insulation stripping apparatus and during a crimping process performed by the crimping tool head.

2. The crimping machine according to patent claim 1, wherein the clamping apparatus is connected rigidly, preferably by means of a detachable connection, for example a screw, plug and/or clamping connection, to the crimping tool head.

3. The crimping machine according to claim 1, where in the clamping apparatus has at least one upper clamping jaw and one lower clamping jaw which are moveable in opposite directions to one another in the vertical direction via one or more spring elements, for example pressure springs (13).

4. The crimping machine according to claims 1, wherein the clamping jaws are arranged so as to be moveable in a cuboid housing open at least at the bottom, and the housing has, on its top two slots arranged parallel to one another and perpendicularly to the longitudinal direction of the cable path.

5. The crimping machine according to claim 1, wherein the upper clamping jaw comprises a clamping jaw arm and a clamping jaw finger bent at right angles in the direction of the lower clamping jaw, the bottom of the finger clamping the cable during the entire processing.

6. The crimping machine according to claim 1, wherein the lower clamping jaw comprises a substantially cuboid clamping jaw arm having a lower edge, an arm extension, which is approximately half as wide as the clamping jaw arm and which corresponds approximately to the width of the clamping jaw arm, and a clamping jaw finger bent at right angles from the arm extension in the direction of the upper clamping jaw.

7. The crimping machine according to claim 1, wherein the pressure springs are fixed in a cavity of the clamping jaw arm above the lower edge.

8. The crimping machine according to claim 1, wherein at least one pin each of different lengths is attached to each clamping jaw in the region of the clamping jaw arms, the longer pin of the lower clamping jaw passing through the first slot and the shorter pin of the upper clamping jaw passing through the second slot, and the pins forming the end stops for the open position of the clamping jaws.

* * * * *